US010035236B2

(12) United States Patent
Roeck et al.

(10) Patent No.: US 10,035,236 B2
(45) Date of Patent: Jul. 31, 2018

(54) HANDHELD ABRADING MACHINE

(71) Applicant: Flex-Elektrowerkzeuge GmbH, Steinheim/Murr (DE)

(72) Inventors: Dirk Roeck, Ingersheim (DE); Udo Panzer, Weissach (DE); Nazim Sabuncuoglu, Ludwigsburg (DE)

(73) Assignee: Flex-Elektrowerkzeuge GmbH, Steinheim/Murr (DE)

( * ) Notice: Subject to any disclaimer, the term of this patent is extended or adjusted under 35 U.S.C. 154(b) by 153 days.

(21) Appl. No.: 15/183,960

(22) Filed: Jun. 16, 2016

(65) Prior Publication Data

US 2017/0021471 A1 Jan. 26, 2017

Related U.S. Application Data

(63) Continuation of application No. PCT/EP2014/076911, filed on Dec. 8, 2014.

(30) Foreign Application Priority Data

Dec. 19, 2013 (DE) ..... 10 2013 114 469

(51) Int. Cl.
*B24B 7/18* (2006.01)
*B24B 23/02* (2006.01)
(Continued)

(52) U.S. Cl.
CPC ..... *B24B 7/184* (2013.01); *B24B 7/186* (2013.01); *B24B 23/028* (2013.01);
(Continued)

(58) Field of Classification Search
CPC ..... B24B 7/184; B24B 7/186; B24B 23/028; B24B 27/0084; B24B 27/027; B24B 47/12
(Continued)

(56) References Cited

U.S. PATENT DOCUMENTS 604,836 A 5/1898 McDonald
4,685,252 A * 8/1987 Ponce ..... B24B 23/04 451/354
(Continued)

FOREIGN PATENT DOCUMENTS

DE 19629989 1/1999
DE 19815443 12/1999
(Continued)

OTHER PUBLICATIONS

International Search Report for corresponding application PCT/EP2014/076911 dated Jan. 30, 2015, 3 pages.

*Primary Examiner* — George Nguyen
(74) *Attorney, Agent, or Firm* — Lipsitz & McAllister, LLC

(57) ABSTRACT

In order to provide a handheld abrading machine which is of robust construction and is easy and comfortable to handle, it is proposed that the handheld abrading machine comprise a holding device for holding the abrading machine, a drive motor and a tool head, wherein the tool head is arranged on the holding device such as to be moveable by means of a moving device, wherein the tool head is pivotal relative to the holding device about one or more pivotal axes by means of the moving device and wherein a distance of the tool head from the holding device is variable by means of the moving device.

15 Claims, 16 Drawing Sheets

(51) Int. Cl.
*B24B 27/00* (2006.01)
*B24B 27/027* (2006.01)
*B24B 47/12* (2006.01)

(52) U.S. Cl.
CPC ..... *B24B 27/0084* (2013.01); *B24B 27/027* (2013.01); *B24B 47/12* (2013.01)

(58) Field of Classification Search
USPC ..... 451/344–359
See application file for complete search history.

(56) References Cited

U.S. PATENT DOCUMENTS 4,782,632 A * 11/1988 Matechuk ..... B24B 7/184 451/354
5,690,545 A 11/1997 Clowers et al.
6,793,567 B1 * 9/2004 Corkill ..... A47L 11/162 451/350
7,780,506 B2 * 8/2010 Wettstein ..... B24B 7/18 451/354
9,387,566 B2 * 7/2016 Roeck ..... B24B 23/02
2006/0073778 A1 4/2006 Phillips et al.
2008/0163492 A1 * 7/2008 Johansson ..... B23D 59/006 30/124
2010/0242992 A1 * 9/2010 Young ..... A47L 13/253 134/6

FOREIGN PATENT DOCUMENTS

DE 102005021153 11/2006
EP 1719581 11/2006
EP 2196284 6/2010
GB 28435 12/1912

* cited by examiner

HANDHELD ABRADING MACHINE

RELATED APPLICATION

This application is a continuation of international application No. PCT/EP2014/076911 filed on Dec. 8, 2014, and claims the benefit of German application No. 10 2013 114 469.1 filed on Dec. 19, 2013, which are incorporated herein by reference in their entirety and for all purposes.

FIELD OF DISCLOSURE

The present invention relates to a handheld abrading machine and in particular to a so-called long-neck abrader.

BACKGROUND OF THE INVENTION

A handheld abrading machine is known from DE 10 2005 021 153 A1 for example.

SUMMARY OF THE INVENTION

The object of the present invention is to provide a handheld abrading machine which is of robust construction and is easy and comfortable to handle.

In accordance with the invention, this object is achieved by a handheld abrading machine which comprises a holding device for holding the abrading machine, a drive motor and a tool head, wherein the tool head is arranged to be moveable on the holding device by means of a moving device, wherein the tool head is pivotal relative to the holding device about one or more pivotal axes by means of the moving device and wherein a distance of the tool head from the holding device is variable by means of the moving device.

Due to the fact that, in accordance with the invention, a pivotal movement of the tool head relative to the holding device as well as a variation in the distance of the tool head from the holding device are provided by means of a moving device, disturbing forces occurring when the abrading machine is in use can preferably be minimized so that the abrading machine is preferably more stable and is easy and comfortable for a user to handle.

In one embodiment of the invention, provision is made for the distance of the tool head from the holding device to be made variable by means of the moving device by pivoting the tool head about one or more pivotal axes. The pivotal movement of the tool head about one or more pivotal axes preferably causes and/or determines the variation of the distance of the tool head from the holding device.

Provision may be made for a distance of a bearing point of the tool head which is arranged on a fork element to be variable from a distal end of the holding device by means of the moving device.

It can be advantageous if the moving device comprises a rotating device for pivoting the tool head about one or more pivotal axes and a displacing device for displacing the tool head relative to the holding device.

In particular, provision may be made for the tool head to be linearly displaceable relative to the holding device Preferably, one or more pivotal axes of the tool head are displaceable in parallel by means of the displacing device.

In one embodiment of the invention, provision may be made for the moving device to comprise a displacing device for displacing the tool head relative to the holding device, wherein the displacing device is preferably integrated into a fork element of the abrading machine.

It can be expedient if the abrading machine comprises a coupling device for forcing the pivotal movement of the tool head to be coupled to the movement of the tool head for the purposes of changing the distance from the holding device.

For example, provision may be made for the moving device to comprise a coupling device in the form of a toothed wheel device and/or a toothed rack device for forcing the pivotal movement of the tool head to be coupled to the movement of the tool head for the purposes of changing the distance from the holding device.

In connection therewith, provision may be made for example for the toothed wheel device to be arranged on the tool head and in particular to be connected in mutually non-rotatable manner to a swivel ring of the tool head.

The toothed rack device is then arranged in particular on a fork element which is arranged on the holding device and/or is integrated into the fork element which is arranged on the holding device.

In particular, the effect that each change in the pivotal orientation of the tool head simultaneously causes a change in the distance of the tool head from the holding device can be achieved by means of a coupling device for forcing the pivotal movement of the tool head to be coupled to the movement of the tool head for the purposes of changing the distance from the holding device.

It can be expedient if the moving device comprises a guidance device, in particular a guide channel, along which the tool head is displaceable for the purposes of changing the distance from the holding device.

In particular, provision may be made for the moving device to comprise a guidance device, in particular a guide channel, along which the tool head is displaceable substantially linearly for the purposes of changing the distance from the holding device.

In particular, the guide channel is a guide-way or a guide track.

In a further embodiment of the invention, provision may be made for the moving device to comprise a multi-articulated linkage device which has two or more rotational axes running in parallel with each other.

For example, provision may be made for the moving device to comprise a multi-articulated linkage device which has three, four or more rotational axes running in parallel with each other.

The rotational axes of the multi-articulated linkage device are not necessarily pivotal axes of the tool head. Rather, one or more pivotal axes of the tool head can preferably be realized together by means of the rotational axes and in particular by means of a plurality of rotational axes. In particular, provision may be made for a virtual pivotal axis of the tool head, i.e. a pivotal axis of the tool head which does not run through a shaft or a holder or a mounting of the tool head, to be provided by means of a plurality of rotational axes of a multi-articulated linkage device.

The rotational axes of the moving device are preferably axes about each of which at least one component of the multi-articulated linkage device, but not necessarily the tool head, is rotatable.

Preferably, a displacement of the tool head along a guidance device can be achieved by means of a multi-articulated linkage device.

The multi-articulated linkage device may preferably form a rotating device for pivoting the tool head about one or more pivotal axes and/or a displacing device for displacing the tool head relative to the holding device or it can be a component thereof.

In one embodiment of the invention, provision is made for the multi-articulated linkage device to be a positively-coupled multi-articulated linkage device, in which a change in an angular position of one joint of the multi-articulated linkage device effects a change in an angular position of another joint of the multi-articulated linkage device and in particular of all the other joints of the multi-articulated linkage device.

In particular, provision may be made for the same change in the angular position of the one joint to always cause the same change in the angular position of the other joint or all the other joints.

In particular, by means of a positively-coupled multi-articulated linkage device it can preferably be effected that a pivoting of the tool head about one or more pivotal axes also leads simultaneously to a specific change in the distance of the tool head from the holding device.

Provision may be made for the moving device to comprise a lever device by means of which the tool head is pivotal into predetermined pivotal orientations, in particular, in dependence on an angular position of the joints of a multi-articulated linkage device and/or in dependence on a displacement position of the tool head relative to the holding device.

Furthermore, the object underlying the present invention is achieved by a handheld abrading machine which, as an alternative or in addition to the previously specified features, comprises the following: a holding device for holding the abrading machine, a drive motor and a tool head, wherein the tool head is arranged on the holding device such as to be moveable by means of a moving device, wherein a tool holder of the tool head is coupled to the drive motor by means of a transmission shaft, wherein the abrading machine comprises at least one connecting device for connecting the transmission shaft to the drive motor and/or to the tool holder of the tool head in torque-transmitting manner, wherein the connecting device comprises a freewheel coupling for transmitting torque in only one direction of rotation.

In particular, a freewheel coupling is an overrunning coupling.

Preferably, torsional vibrations can be decoupled by means of a freewheel coupling. In particular, the effect that vibration of a tool holder cannot be transferred back to the transmission shaft can preferably be obtained by means of a freewheel coupling.

Furthermore, the object underling the present invention can be achieved by means of a handheld abrading machine which, as an alternative or in addition to the previously described features, comprises the following: a holding device for holding the abrading machine, a drive motor and a tool head, wherein the tool head is arranged on the holding device such as to be moveable by means of a moving device, wherein a tool holder of the tool head is coupled to the drive motor by means of a transmission shaft, wherein the abrading machine comprises two shaft holders for holding two ends of the transmission shaft and/or two ends of a casing of the transmission shaft, wherein at least one end of the transmission shaft and/or at least one end of the casing is moveable relative to the associated shaft holder.

In particular, provision may be made for at least one end of the transmission shaft and/or at least one end of the casing to be displaceable relative to the associated shaft holder, for example, linearly displaceable.

The transmission shaft and/or the casing are preferably flexible, resilient and/or pliant.

At least one end of the transmission shaft and/or at least one end of the casing are preferably moveable relative to the associated shaft holder along a main direction of extent of the transmission shaft in a region of the associated shaft holder.

The casing and the transmission shaft are preferably displaceable relative to each other.

Furthermore, provision may be made for the casing and/or the transmission shaft to be displaceable relative to only one or relative to both shaft holders.

In one embodiment of the invention, provision may be made for a shaft holder to be arranged on the tool head and/or a shaft holder to be arranged at a distal end of a substantially tubular bar of the holding device.

In particular, the abrading machine comprises a substantially tubular bar which has a proximal end and a distal end, wherein the drive motor is preferably arranged at the proximal end and wherein the tool head is preferably arranged at the distal end.

It can be expedient if the abrading machine comprises a transmission shaft which connects the drive motor to a tool holder of the tool head for the purposes of transmitting torque thereto and which runs at least in sections thereof within the tubular bar.

A connecting device for connecting the transmission shaft to the drive motor and/or to the tool holder of the tool head for the purposes of transmitting torque thereto preferably comprises at least one transmission gear such as a reduction gear, a sun gear wheel and/or a planetary gear wheel for example.

The tool holder and an end of the transmission shaft facing the tool holder preferably have a common rotational axis at least to an approximate extent. This rotational axis, together with the tool head, is preferably pivotal about one or more pivotal axes by means of the moving device.

In particular, the tool holder and the end of the transmission shaft facing the tool holder are pivotal together with the tool head about one or more pivotal axes.

An end of the transmission shaft remote from the tool head is preferably not connected to the holding device in pivotal manner.

Thus in particular, a deflection movement of the transmission shaft and/or the casing results from a pivotal movement of the tool head.

The differing deformation states (bending states) of the transmission shaft and/or the casing relative to the holding device for different pivotal orientations (pivotal positions) of the tool head can lead to impairments in the stability and/or the user friendliness of the abrading machine in the case of a rigid connection of the casing and/or the transmission shaft. In particular, these negative aspects can preferably be avoided or at least moderated by the variation in the distance of the tool head from the holding device when the tool head pivots by means of a freewheel coupling for transmitting the torque in only one direction of rotation and/or by a moveable holder for the transmission shaft and/or the casing.

A tool receivable and/or received by means of the tool holder is drivable in particular in rotating, oscillatory and/or eccentric manner.

Furthermore, the handheld abrading machine in accordance with the invention can exhibit particular ones or a plurality of the features and/or advantages described in the following:

A sliding element, in particular a tube consisting of a polytetrafluorethylene material (PTFE material), can be arranged between the transmission shaft and the casing in order to particularly minimize friction between the transmission shaft which is rotating when the abrading machine is in operation and the static casing.

The tool head is pivotal by means of the moving device about at least one pivotal axis preferably in an angular range of at least approximately 80°, preferably at least approximately 90°, for example, approximately 100°.

The tool head is preferably displaceable and especially linearly displaceable through at least approximately 20 mm, for example, through at least approximately 30 mm.

Preferably, the moving device comprises at least two mutually engaging toothed components which, in the event of pivoting thereof relative to each other, simultaneously effect a displacement thereof relative to each other.

In one embodiment of the invention, a drive shaft, in particular the transmission shaft, is decoupled by means of a freewheel coupling from an output shaft, in particular an output shaft that is connected to the tool holder of the tool head in mutually non-rotatable manner. Preferably, torsional vibrations, which are caused in particular by the flexible transmission shaft that is biased by the torque-transmitting process, can thereby be reduced.

Preferably, a continuous and/or automatic change in the distance of the tool head from the holding device is realizable whilst the tool head is being pivoted relative to the holding device by means of the moving device.

The abrading machine in accordance with the invention preferably makes it possible to provide a longer life span for the transmission shaft since, in particular, larger bending radii are involved and consequently the path of the casing is a straight-line.

Preferably, friction between the transmission shaft and the casing can be reduced so that a greater amount of effective power can be provided to the tool holder and the tool arranged thereupon for the same power output.

In particular, if energy-expending pushing away of the casing during the bending thereof can be prevented, the moving device can enable effortless pivoting of the tool head relative to the holding device.

Finally, the abrading machine preferably makes it possible to produce a still better abrading effect due in particular to the fact that the pivoting of the tool head relative to the holding device is not impaired or only to an insignificant extent by the bending of the transmission shaft and/or the casing.

In particular, if at least one end of the transmission shaft and/or at least one end of the casing is moveable relative to an associated shaft holder, adequate clearance for the movement of the transmission shaft and/or the casing can preferably be created in order to adjust and/or compensate for any surplus length of the transmission shaft and/or the casing at different pivotal positions (pivotal orientations) of the tool head.

Bending radii of the transmission shaft and/or the casing can preferably be increased and thus the life span of the transmission shaft as well as the flexibility of the tool head on a surface being worked upon can be significantly optimised by such an adjustment to the length.

Preferably, the movement of the casing and/or the transmission shaft relative to the holding device and/or relative to the tool head occurs without any bulging, without kinks and/or without narrow bending radii.

The movement of the at least one end of the transmission shaft and/or the at least one end of the casing relative to the associated shaft holder preferably occurs as a result of the inherent rigidity of the transmission shaft and/or the casing and due to the pivotal movement of the tool head relative to the holding device.

As an alternative or in addition thereto however, provision can also be made for a positive drive arrangement by means of which at least one end of the transmission shaft and/or at least one end of the casing is moveable relative to the associated shaft holder, being moveable in particular into the shaft holder or out of the shaft holder.

Further preferred features and/or advantages of the invention form the subject matter of the following description and the graphical illustration of exemplary embodiments.

BRIEF DESCRIPTION OF THE DRAWINGS

Similar or functionally equivalent elements are provided with the same reference symbols in all the Figures.

DETAILED DESCRIPTION

Figure 1:
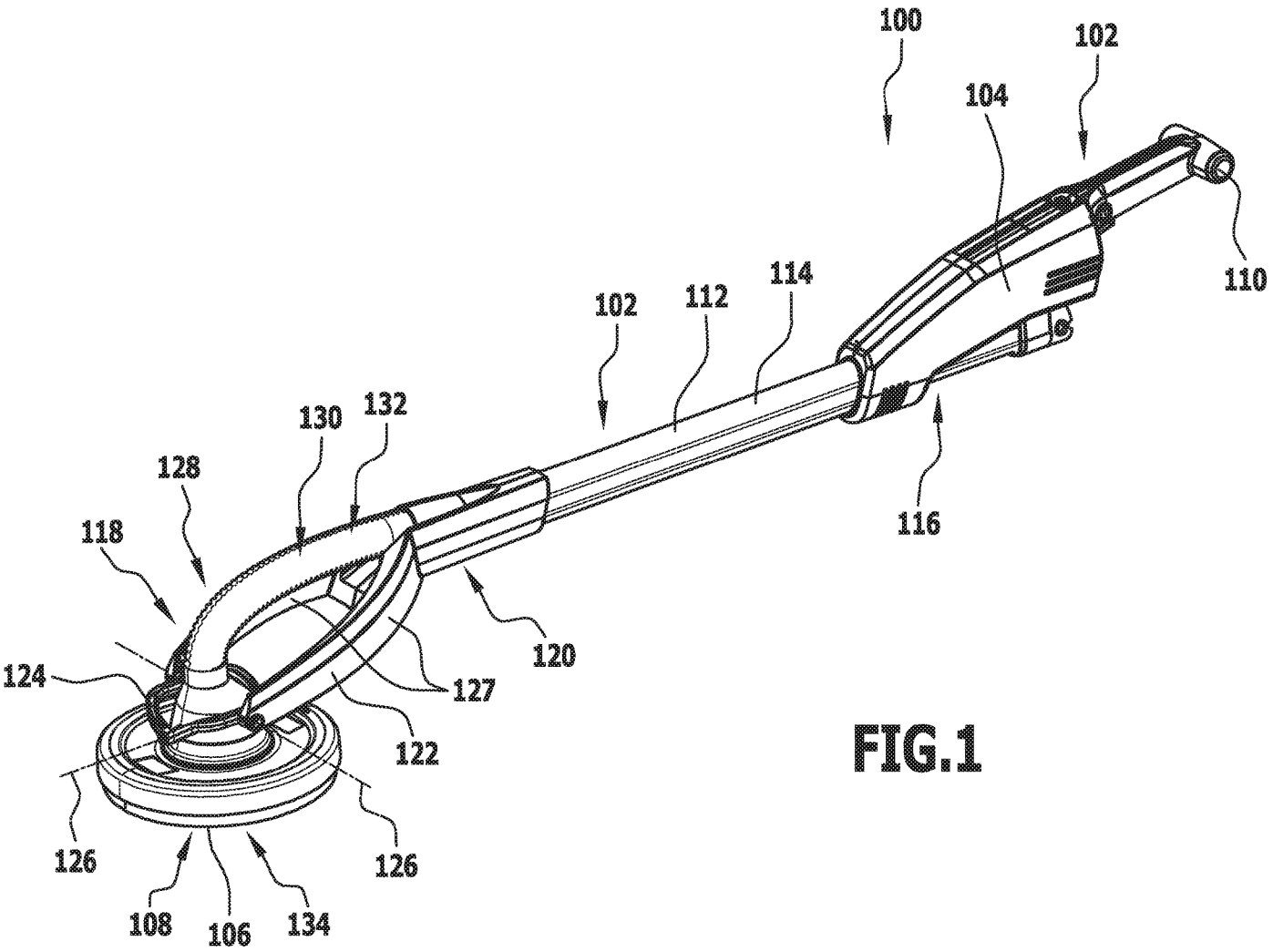
FIG. 1 shows a schematic perspective illustration of a first embodiment of a handheld abrading machine in which a pivotal tool head is provided.

A first embodiment of a handheld abrading machine bearing the general reference 100 which is illustrated in FIG. 1 serves for treating the surfaces of walls, floors and ceilings for example.

In particular, such an abrading machine 100 is a so-called long-neck abrader.

The abrading machine 100 comprises a holding device 102 for holding the abrading machine 100, a drive motor 104 for driving a tool 106 and a tool head 108 on which the tool 106 is arrangeable or is arranged.

The holding device 102 comprises in particular a handle 110 and also a tubular bar 112.

The tubular bar 112 is in the form of a tubing element 114 for example.

The drive motor 104 is arranged on the tubular bar 112 at one end and the tool head 108 at the other end.

Thereby, the drive motor 104 is arranged at a proximal end 116 of the tubular bar 112.

The tool head 108 is arranged at a distal end 120 of the tubular bar 112 such as to be moveable by means of a moving device 118.

In particular, the abrading machine 100 comprises a fork element 122 which is fixed at the distal end 120 of the tubular bar 112 and serves for holding the tool head 108 in moveable manner.

On the fork element 122 there is arranged for example a swivel ring 124 of the moving device 118 such as to be pivotal about a pivotal axis 126.

In turn, the tool head 108 is preferably arranged on the swivel ring 124 such as to be pivotal about a further pivotal axis 126.

The two pivotal axes 126 are preferably oriented perpendicularly to each other.

In particular, the swivel ring 124 and the tool head 108 are arranged, at least in sections thereof, between two fork arms 127 of the fork element 122.

In the case of the first embodiment of the abrading machine 100 illustrated in FIG. 1, the moving device 118 comprises a pivoting device 128 formed by means of the swivel ring 124.

The tool head 108 is thus pivotal in particular relative to the holding device 102, and is pivotal in particular relative to the tubular bar 112.

For the purposes of transmitting a drive movement, in particular a torque, from the drive motor 104 to the tool 106, the abrading machine 100 comprises a transmission shaft 130 which is flexible at least in sections thereof and which is surrounded by means of a casing 132 so that it is protected.

In particular, the transmission shaft 130 is guided in the casing 132.

The transmission shaft 130 is coupled in mutually non-rotatable manner at one end to the drive motor 104 and at the other end to a tool holder 134 for holding the tool 106.

In this way, torque can be transferred from the drive motor 104 to the tool 106 arranged on the tool holder 134.

The first embodiment of the abrading machine 100 illustrated in FIG. 1 functions as follows:

In operation of the abrading machine 100, i.e. during the usage thereof for working on surfaces, the tool 106 is laid flat on the surface which is to be treated.

In dependence on the position of the user relative to the surface and in dependence on the way in which the user is holding the abrading machine 100, there is a resulting pivotal orientation or a pivotal disposition of the tool head 108 relative to the holding device 102 and particularly relative to the tubular bar 112.

The sections of the transmission shaft 130 and the casing 132 which extend between the holding device 102 and the tool head 108 are thereby curved to different extents in dependence on the currently adopted pivotal position and are thus loaded to different extents. In particular, this difference in curvature can lead to an undesirable effect upon the life span of the abrading machine 100 and/or an undesirable effect upon the ease of handling the abrading machine 100.

It can therefore be advantageous if not only a pivotal movement of the tool head 108 is executable by means of the moving device 118, but if the different curvature of the transmission shaft 130 and/or the casing 132 resulting from the pivoting of the tool head 108 can be simultaneously compensated or otherwise taken into consideration.

In the case of a second embodiment of a handheld abrading machine 100 that is illustrated in FIGS. 2 to 5, provision is therefore made for the moving device 118 to comprise a displacing device 138 in addition to a rotating device 136 for the rotational or pivotal movement of the tool head 108 about the pivotal axes 126.

The tool head 108 can be displaced, in particular, linearly by means of the displacing device 138.

The tool head 108 is thereby displaced relative to the holding device 102 in particular, and relative to the tubular bar 112 in particular.

Preferably, the distance A of the tool head 108 from the holding device 102 and in particular from the tubular bar 112 thereby changes.

Figure 2:
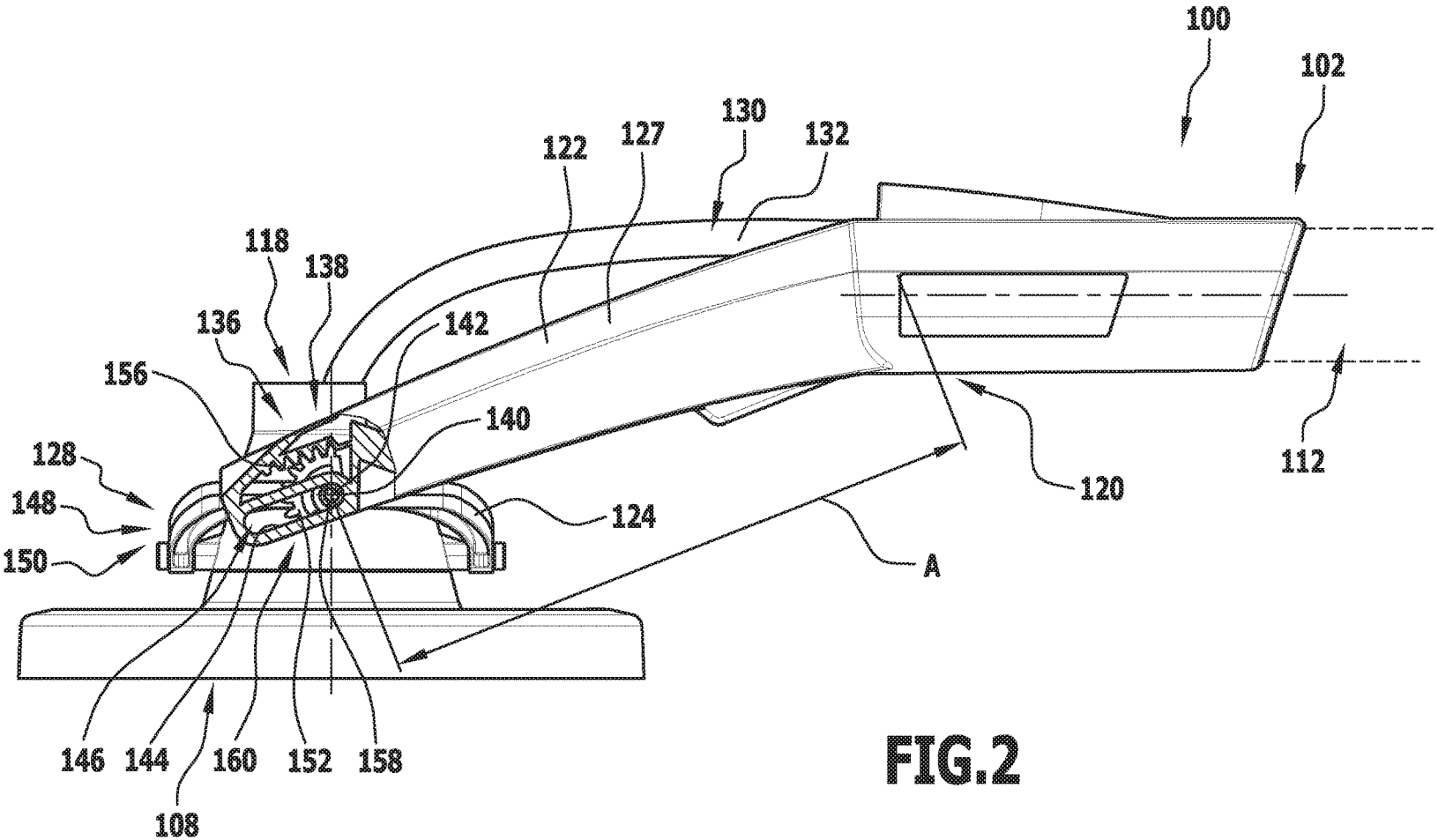
FIG. 2 a schematic partly transparent side view of a second embodiment of an abrading machine in which there is provided a tool head which is pivotal and simultaneously linearly displaceable by means of a toothed wheel device and a toothed rack device.
Figure 3:
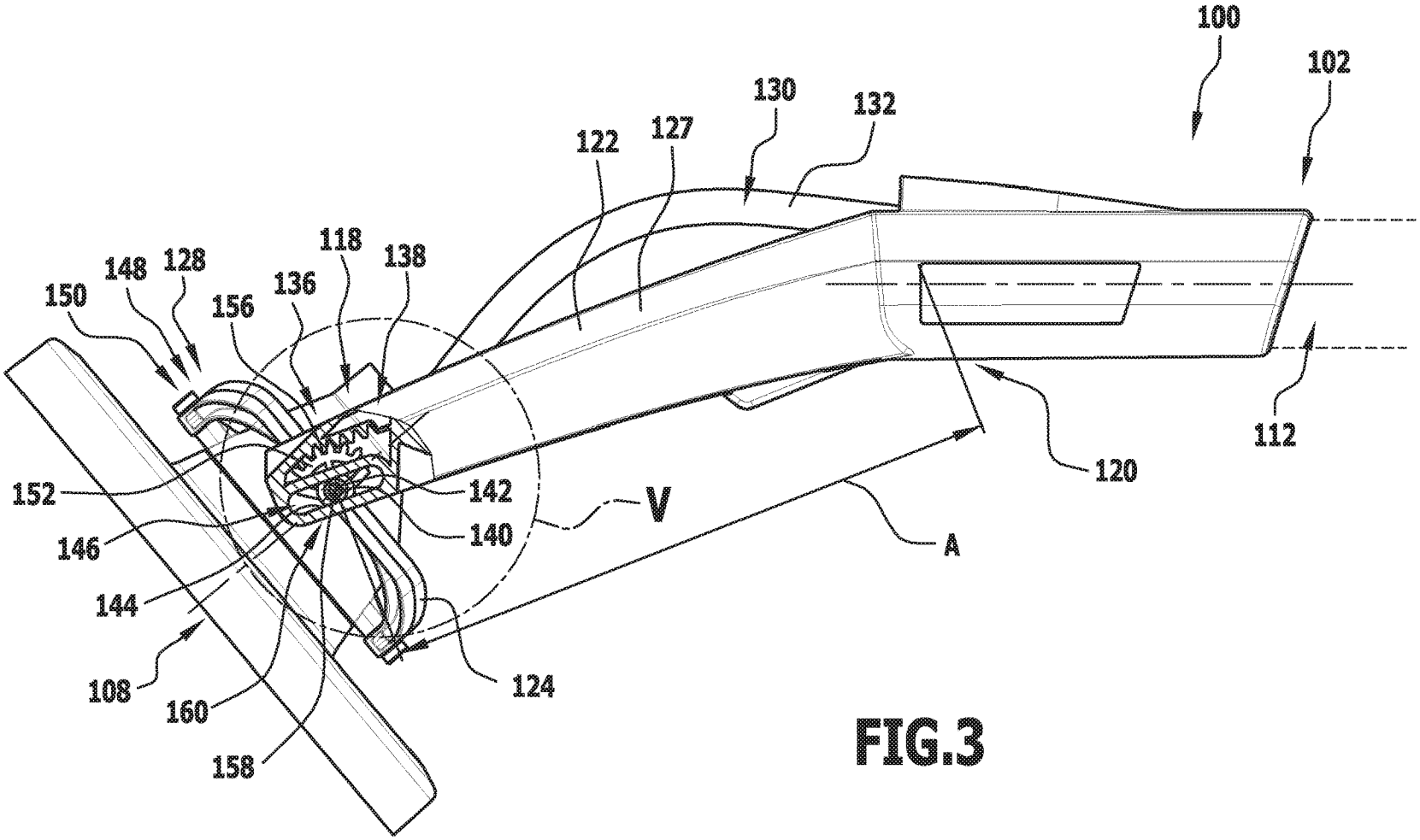
FIG. 3 a schematic illustration corresponding to FIG. 2 of the abrading machine depicted in FIG. 2, wherein the tool head is arranged in an alternative pivotal position.
Figure 4:
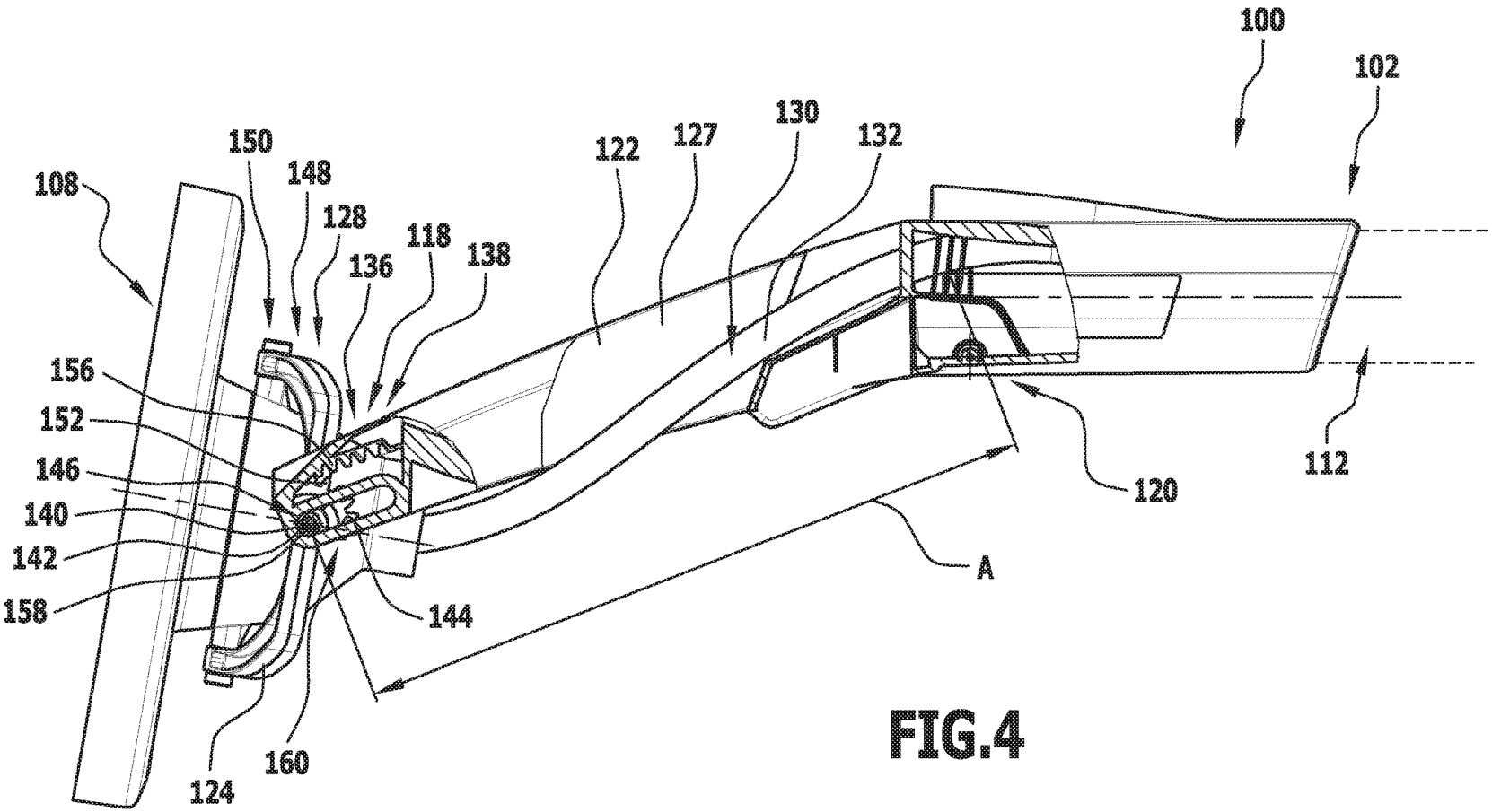
FIG. 4 a schematic illustration corresponding to FIG. 2 of the abrading machine depicted in FIG. 2, wherein the tool head is arranged in a further alternative pivotal position.

As can be perceived particularly from FIGS. 2 to 4, the tool head 108 is arrangeable in different pivotal positions and simultaneously different displacement positions by means of the displacing device 138.

In particular, two bearing points 140 at which the swivel ring 124 is mounted on the fork arms 127 of the fork element 122 are displaced for differing pivotal positions of the tool head 108 relative to the distal end 120 of the tubular bar 112 of the holding device 102.

The distance A of the bearing points 140 from the distal end 120 of the tubular bar 112 is thus variable.

For the purposes of mounting the swivel ring 124 on the fork element 122 there are provided, in the second embodiment of the abrading machine 100 illustrated in FIGS. 2 to 5, two pegs 142 which project away from the swivel ring 124 in mutually opposite directions and engage in guide channels 144 of the fork element 122.

In particular, one guide channel 144 is provided in each fork arm 127 of the fork element 122.

The guide channels 144 are substantially linear guide channels 144 so that the pegs 142 are displaceable together with the tool head 108 substantially linearly relative to the fork element 122 and thus relative to the holding device 102 of the abrading machine 100.

A guidance device 146 of the abrading machine 100 is formed by means of the guide channels 144 and the pegs 142.

In particular, the pegs 142 and the guide channels 144 form the displacing device 138 for displacing the tool head 108 relative to the holding device 102.

Figure 5:
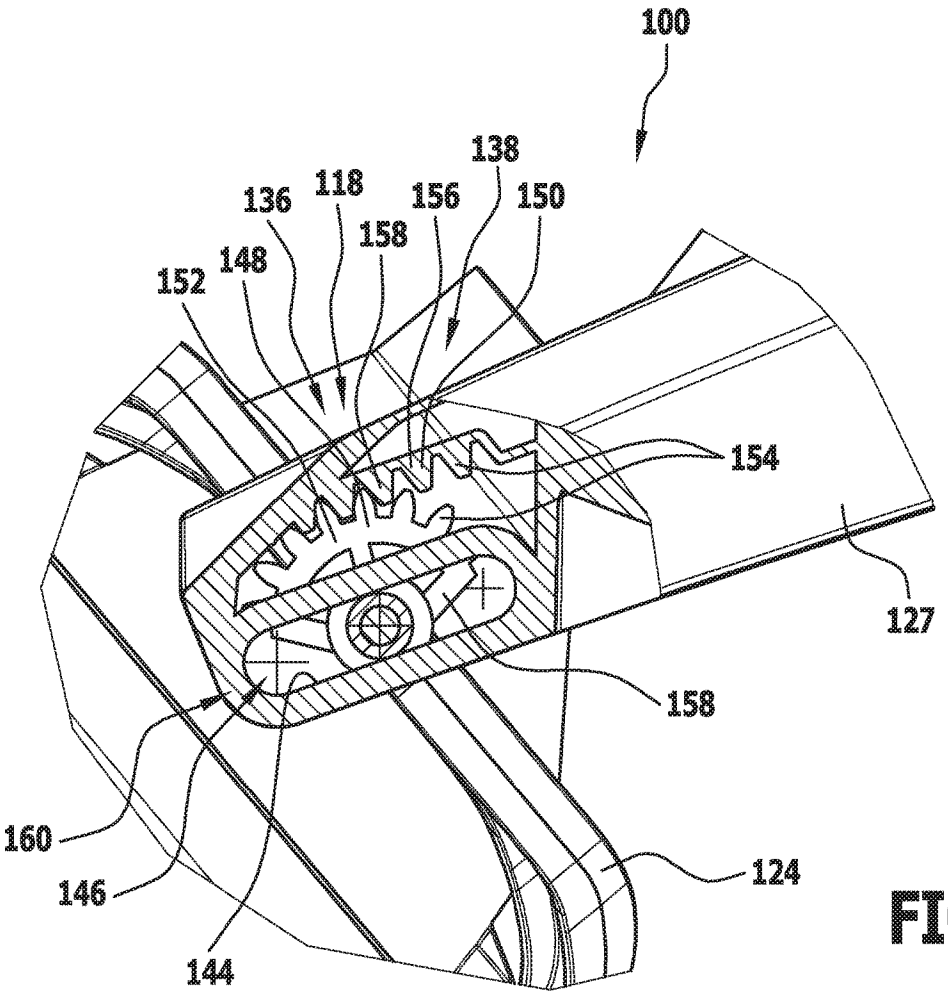
FIG. 5 an enlarged illustration of the region V in FIG. 3.

As can be derived from FIG. 5 in particular, the moving device 118 in the embodiment of the abrading machine 100 illustrated in FIGS. 2 to 5 comprises a toothed wheel device 148 and a toothed rack device 150. The toothed wheel device 148 comprises in particular a toothed wheel element 152 which is provided at least over a section of its periphery with projections 154.

The toothed rack device 150 comprises in particular a toothed rack element 156 which comprises projections 154 that are arranged substantially linearly one behind the other.

The projections 154 of the toothed wheel element 152 are preferably moveable into engagement with the projections 154 of the toothed rack element 156.

Consequently, a displacement of the toothed wheel element 152 relative to the toothed rack element 156 can be caused by the rotation of the toothed wheel element 152.

The toothed wheel element 152 and the toothed rack element 156 are thus coupling elements 158 of a coupling device 160 by means of which the pivotal movement of the tool head 108 and the displacement movement of the tool head 108 are positively coupled together.

Consequently, pivoting of the tool head 108 always leads to a displacement of the tool head 108 relative to the holding device 102 and vice versa.

As can be derived from FIG. 5 in particular, the toothed rack element 156 is arranged, in particular, on the fork arm 127 of the fork element 122.

Preferably, the toothed rack element 156 is integrated into the fork arm 127 of the fork element 122.

It can be expedient if each fork arm 127 comprises a toothed rack element 156 or is provided with a toothed rack element 156.

The toothed wheel element 152 is arranged, in particular, on the swivel ring 124 in mutually non-rotatable manner.

Preferably, two toothed wheel elements 152 are provided, these each being associated with a respective toothed rack element 156 on a respective fork arm 127.

As follows in particular from a comparison of FIGS. 2 to 4 with one another, the tool head 108 is pivotal through more than approximately 90° and is displaceable thereby along the guide channel 144.

In the two pivotal end positions (see FIGS. 2 and 4), the tool head 108 is simultaneously arranged in the two displacement end positions.

Due to the fact that the distance A between the tool head 108 and the tubular bar 112 of the holding device 102 can be varied by means of the displacing device 138 of the moving device 118 when the tool head 108 is pivoted, the bending strain on the transmission shaft 130 and/or the casing 132 can be reduced.

This increases the longevity of the handheld abrading machine 100 and the handling comfort thereof for the user.

In all other respects, the second embodiment of the abrading machine 100 that is illustrated in FIGS. 2 to 5 corresponds in regard to the construction and functioning thereof to the first embodiment illustrated in FIG. 1, and insofar, reference is made to the previous description.

A third embodiment of a handheld abrading machine 100 which is illustrated in FIGS. 6 to 9 differs from the second embodiment illustrated in FIGS. 2 to 5 mainly in that the coupling device 160 is not formed by toothed wheel elements 152 and toothed rack elements 156, but rather, by an articulated joint device 162

In particular, the articulated joint device 162 is a multi-articulated linkage device 164 which comprises a plurality of joints 166.

A plurality of components 168 of the multi-articulated linkage device 164 are preferably rotatable and/or pivotal about rotational axes 170 that are aligned in parallel with each other by means of the joints 166 of the multi-articulated linkage device 164.

The multi-articulated linkage device 164 comprises two components 168 for example.

In connection therewith, one of the components 168 is arranged on the fork element 122 such as to be rotatable about a rotational axis 170 for example.

This component 168 is connected by means of a joint 166 to a further component 168 of the multi-articulated linkage device 164 which is in turn arranged on the swivel ring 124 of the moving device 118 in mutually non-rotatable or rotatable manner.

In correspondence with the second embodiment of the abrading machine 100 illustrated in FIGS. 2 to 5, provision is also made in the third embodiment illustrated in FIGS. 6 to 9 for the swivel ring 124 to comprise two pegs 142 which engage in guide channels 144.

In connection therewith, the guide channels 144 are likewise arranged in the fork arms 127 of the fork element 122, but are oriented at another angle relative to the direction in which the fork arm 127 extends.

Figure 6:
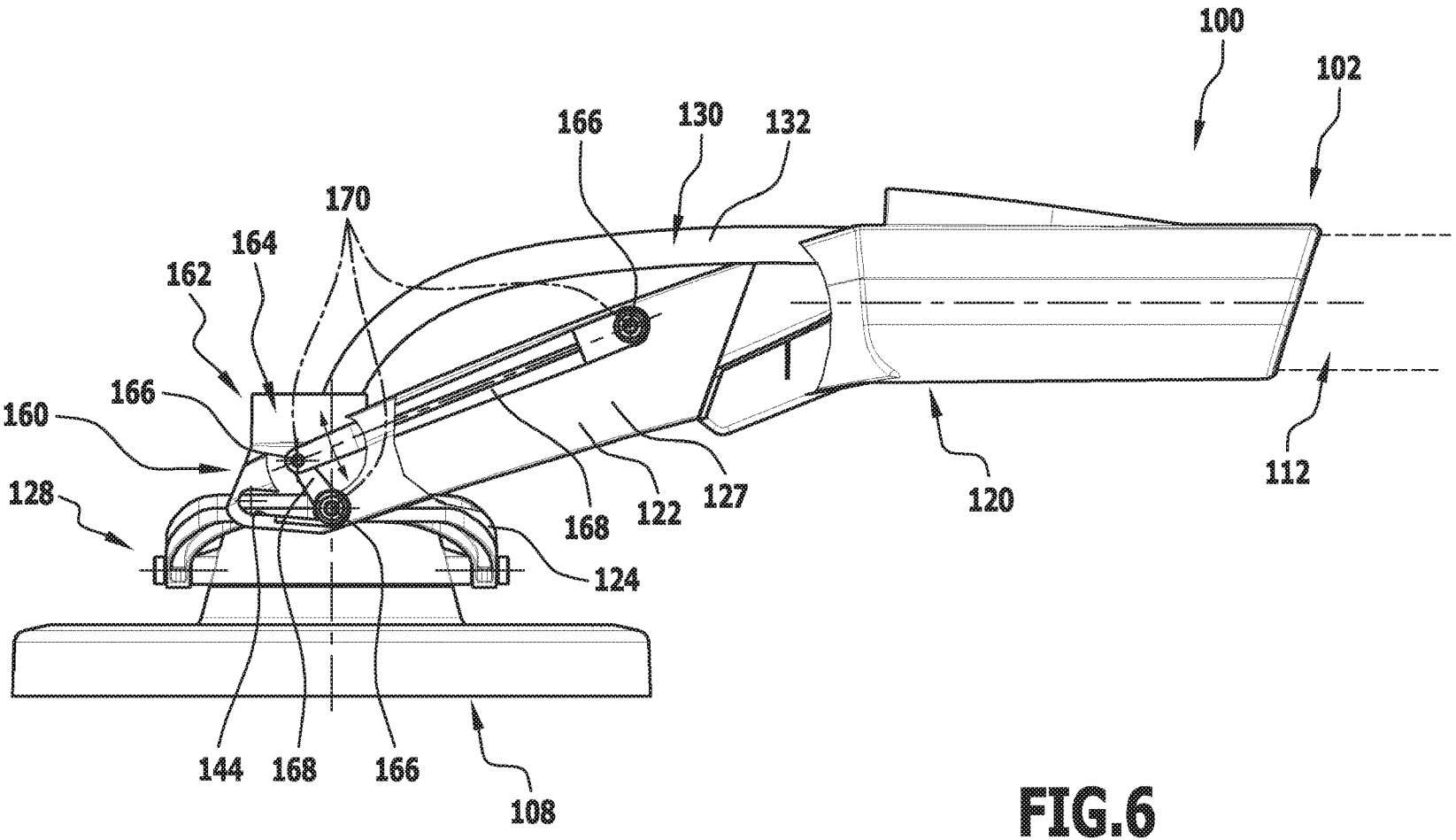
FIG. 6 a schematic illustration of a third embodiment of an abrading machine corresponding to FIG. 2, in which an articulated joint device and a guidance device are provided for pivoting and displacing the tool head.
Figure 7:
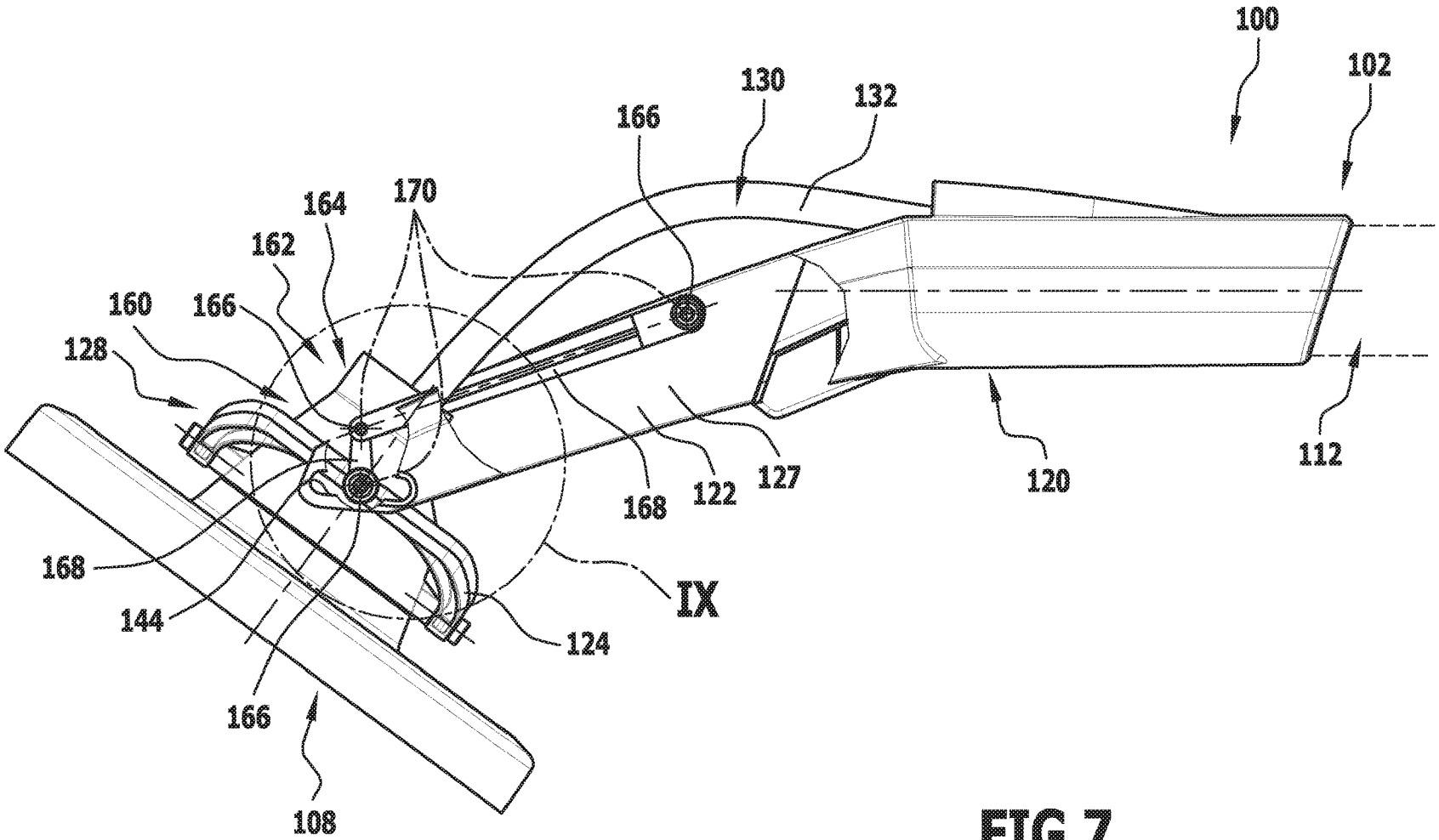
FIG. 7 a schematic illustration corresponding to FIG. 6 of the abrading machine depicted in FIG. 6, wherein the tool head is arranged in an alternative pivotal position.
Figure 8:
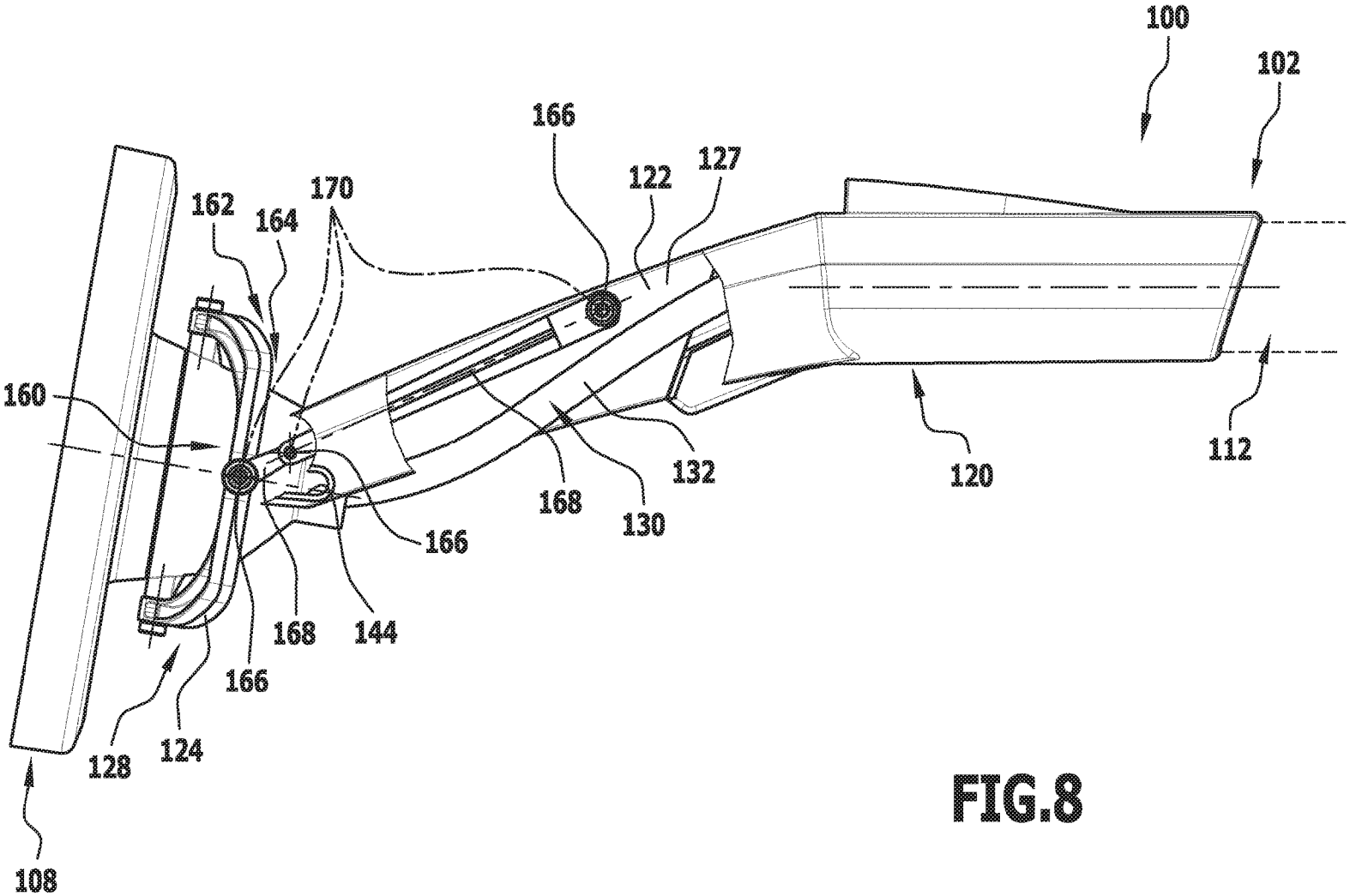
FIG. 8 a schematic illustration corresponding to FIG. 6 of the abrading machine depicted in FIG. 6, wherein the tool head is arranged in a further alternative pivotal position.
Figure 9:
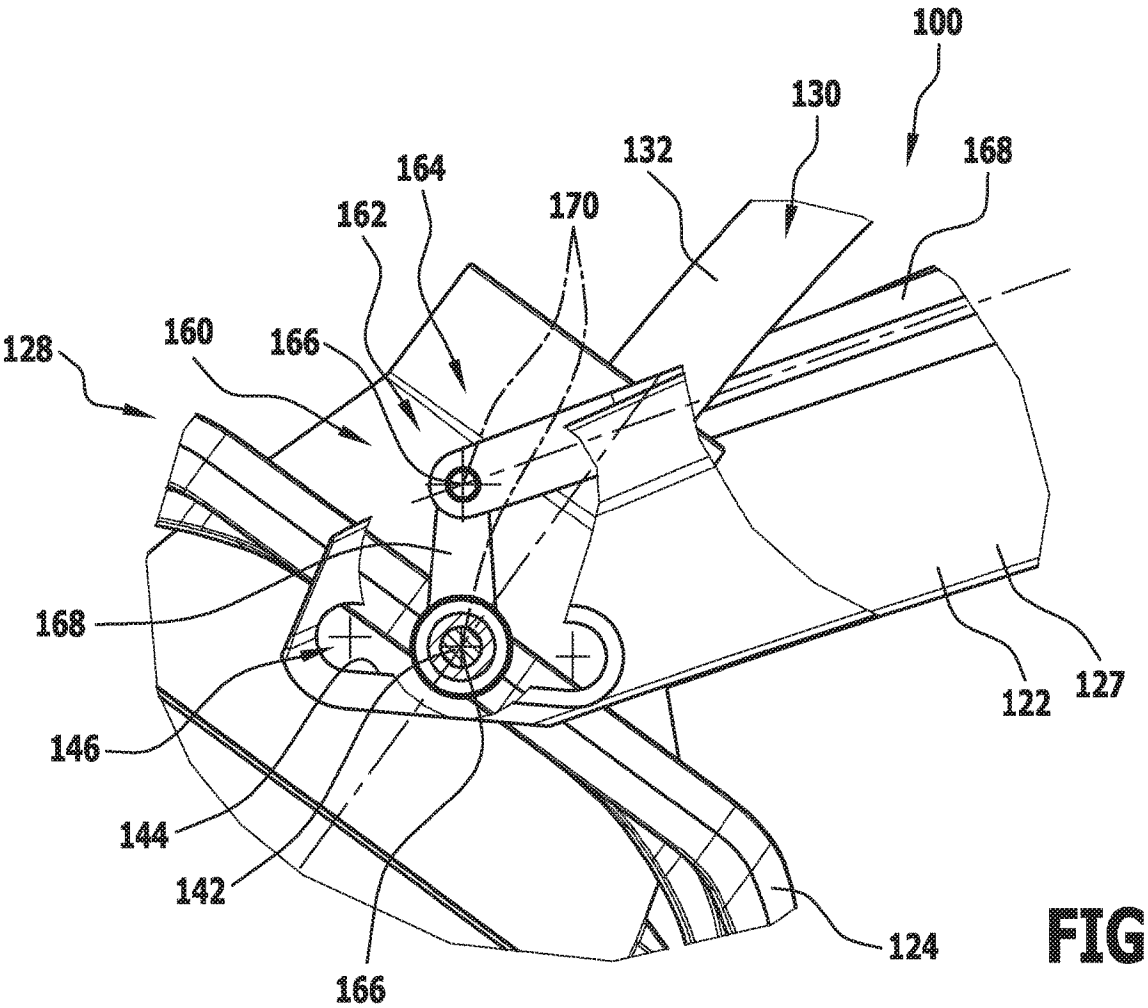
FIG. 9 an enlarged illustration of the region IX in FIG. 7.

As can be derived particularly from FIGS. 6 to 8, the pivotal movement and the displacement movement of the tool head 108 are also positively coupled to one another in the third embodiment of the abrading machine 100.

To this end, one of the components 168 of the multi-articulated linkage device 164 is connected in mutually non-rotatable manner to the swivel ring 124 so that the tool head 108 is also always displaced linearly along the guide channel 144 in the course of the pivoting movement thereof due to the freedom of movement that is limited by means of the multi-articulated linkage device 164.

In all other respects, the third embodiment of the handheld abrading machine 100 that is illustrated in FIGS. 6 to 9 corresponds in regard to the construction and functioning thereof to the second embodiment illustrated in FIGS. 2 to 5, and insofar, reference is made to the previous description.

Figure 10:
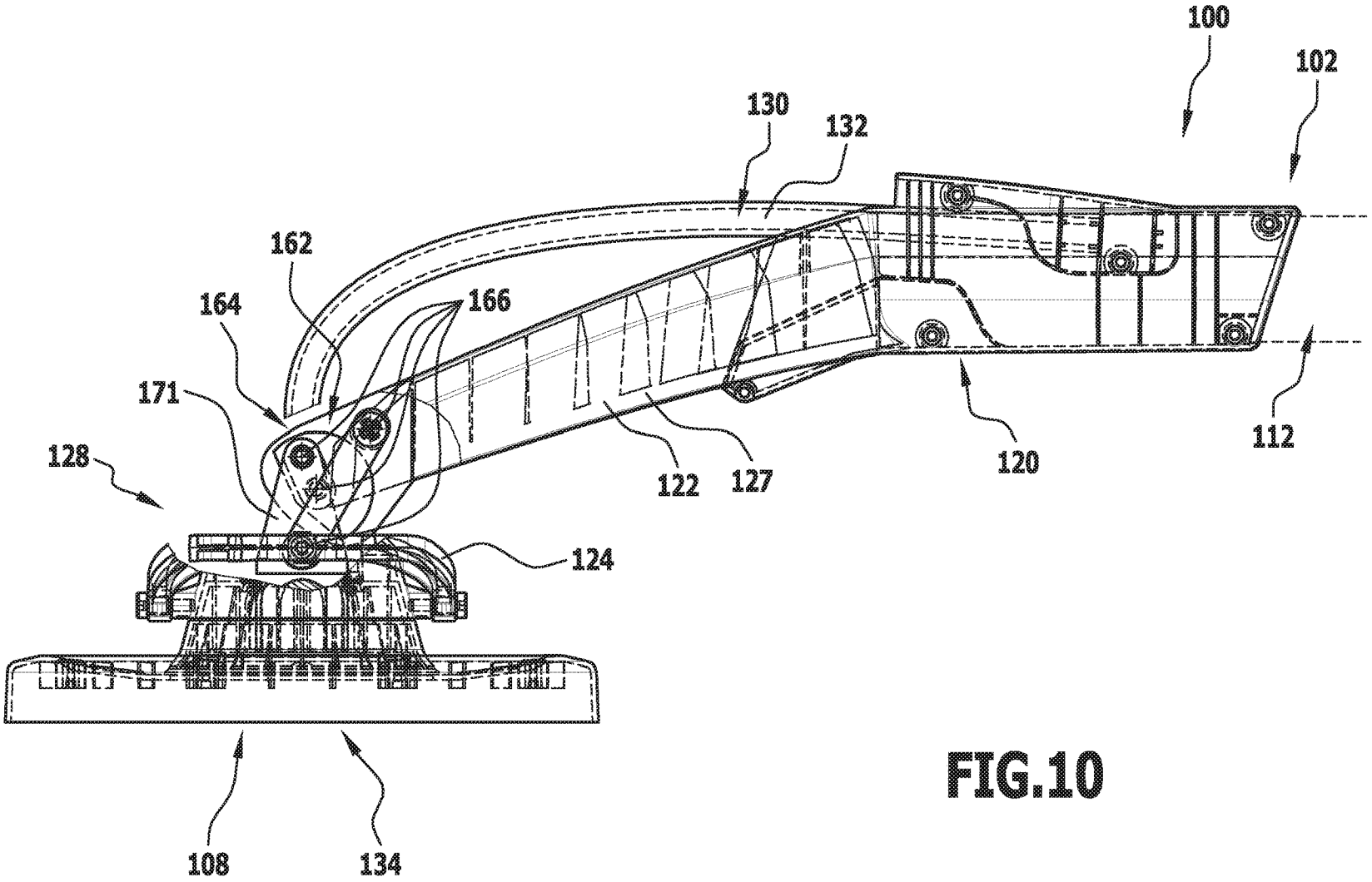
FIG. 10 a schematic illustration of a fourth embodiment of an abrading machine corresponding to FIG. 2, in which a multi-articulated linkage device and a lever device are provided for pivoting and displacing the tool head.
Figure 11:
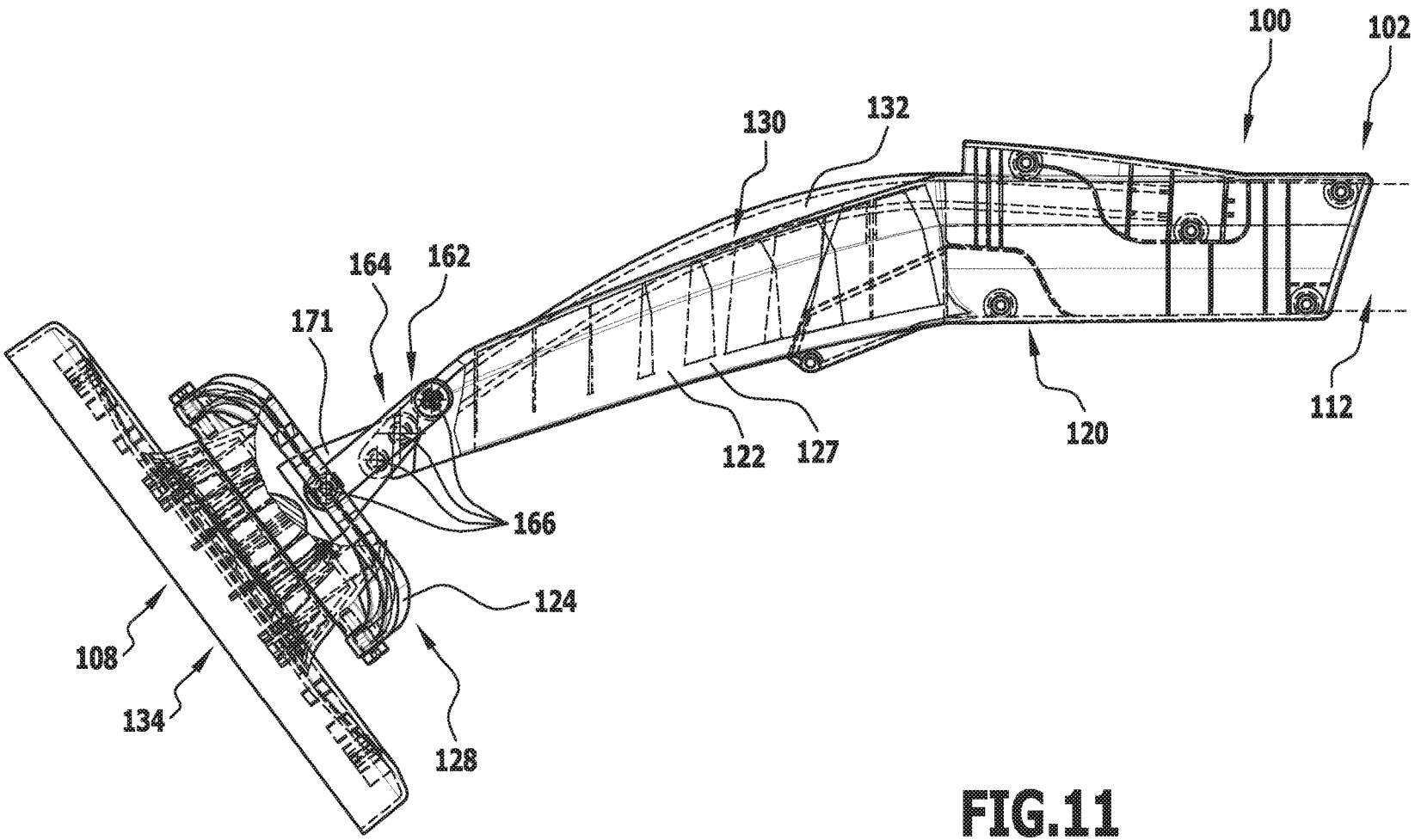
FIG. 11 a schematic illustration of the abrading machine depicted in FIG. 10 corresponding to FIG. 10, wherein the tool head is arranged in an alternative pivotal position.
Figure 12:
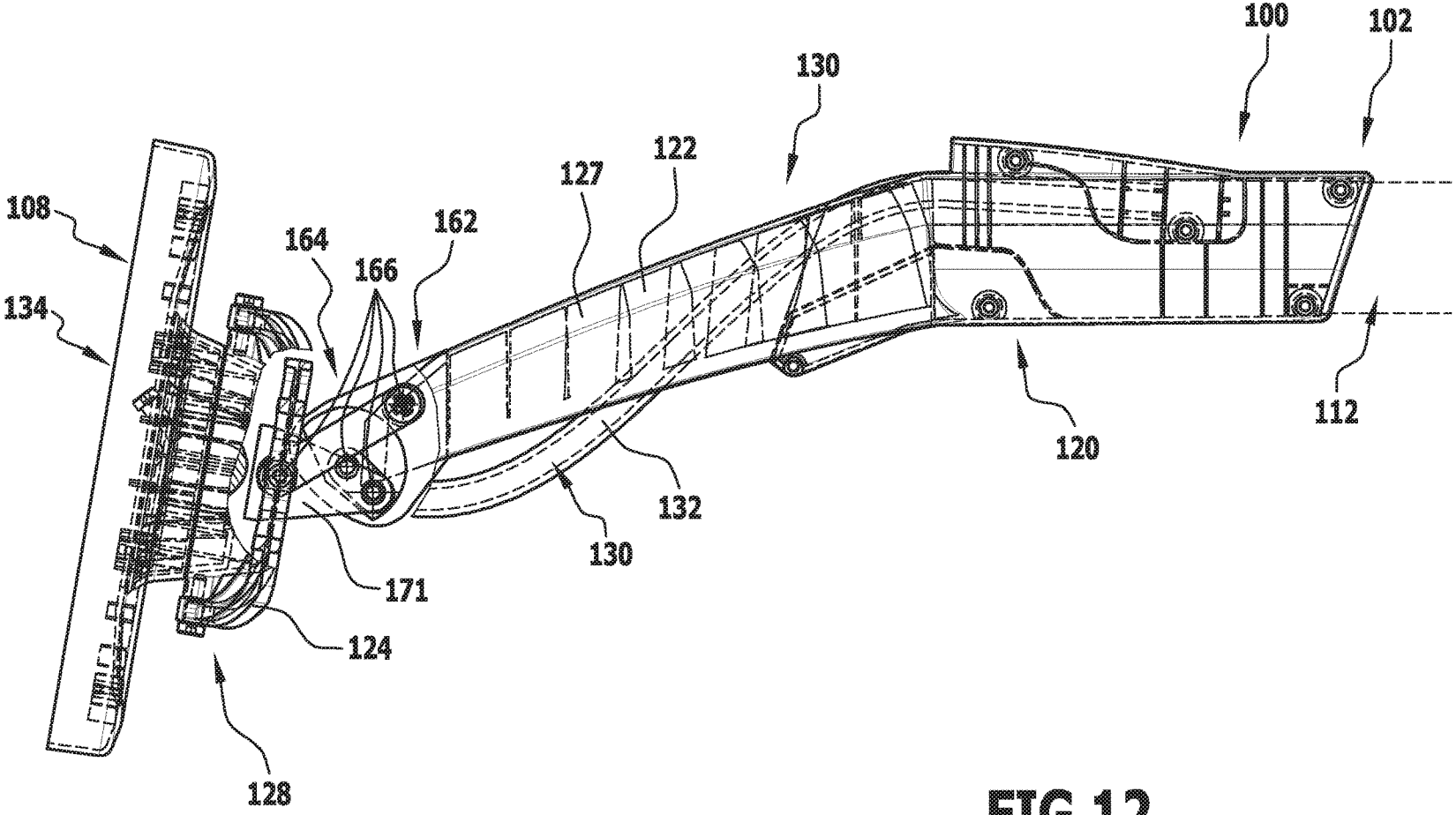
FIG. 12 a schematic illustration corresponding to FIG. 10 of the abrading machine depicted in FIG. 10, wherein the tool head is arranged in a further alternative pivotal position.

A fourth embodiment of a handheld abrading machine 100 which is illustrated in FIGS. 10 to 12 differs from the third embodiment illustrated in FIGS. 6 to 9 mainly in that the multi-articulated linkage device 164 comprises four joints 166 and a lever device 171.

The pivotal movement of the tool head 108 on the one hand and the variation of the distance of the tool head 108 from the holding device 102 on the other can be realized already by means of the four joints 166 and the lever device 171.

In the fourth embodiment of the abrading machine 100 illustrated in FIGS. 10 to 12, a displacing device 138 incorporating a guide channel 144 is thus preferably dispensable.

In all other respects, the embodiment the fourth embodiment of the handheld abrading machine 100 that is illustrated in FIGS. 10 to 12 corresponds in regard to the construction and functioning thereof to the third embodiment illustrated in FIGS. 6 to 9, and insofar, reference is made to the previous description.

Figure 13:
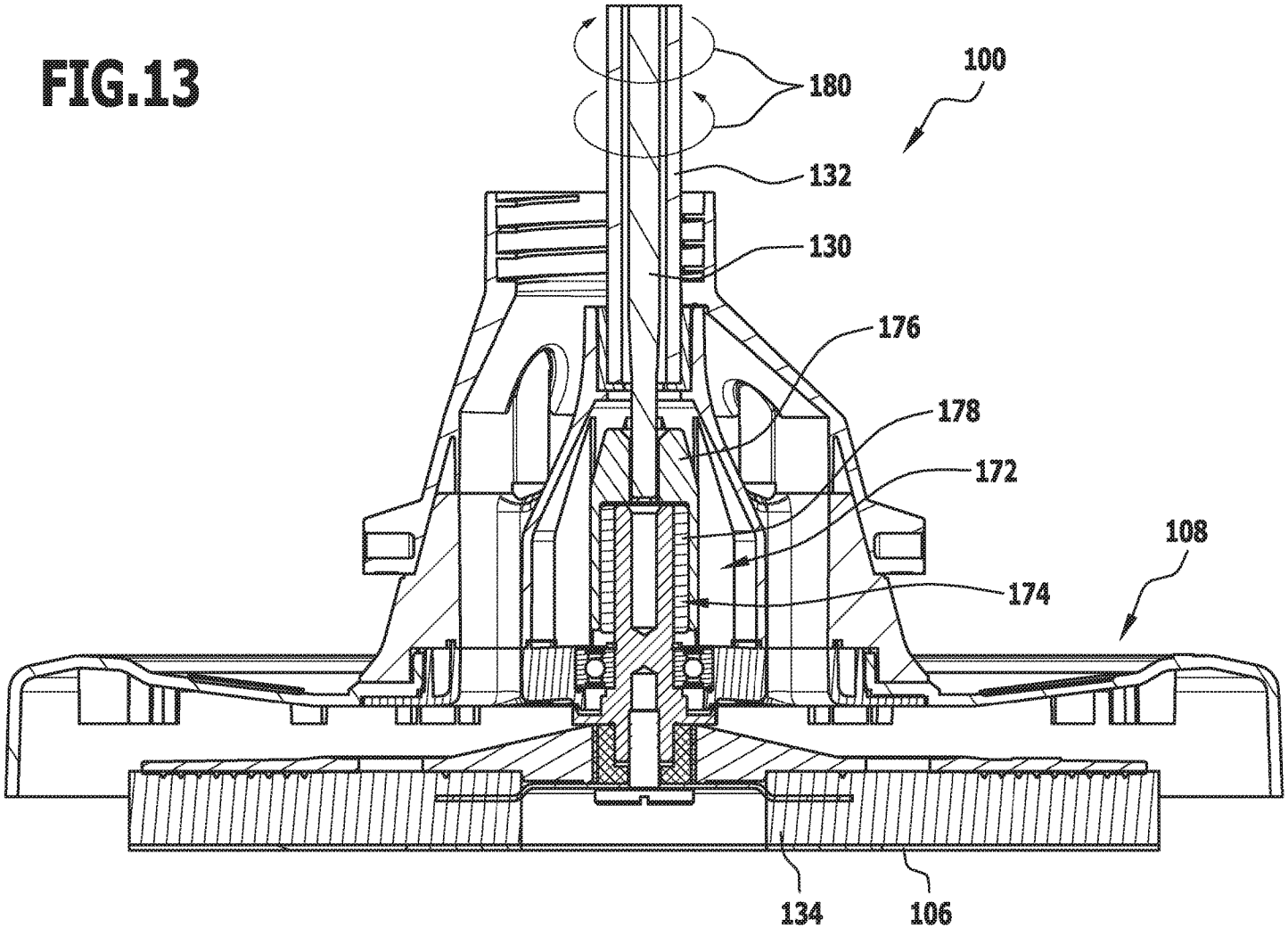
FIG. 13 a schematic vertical cross section through a tool head of a fifth embodiment of an abrading machine, in which a transmission shaft of the abrading machine is connected to a tool holder of the tool head by means of a freewheel coupling.

A fifth embodiment of a handheld abrading machine 100 which is illustrated in FIG. 13 comprises an advantageous connecting device 172 for connecting the transmission shaft 130 to the tool holder 134 of the tool head 108.

The connecting device 172 comprises a freewheel coupling 174.

The freewheel coupling 174 comprises for example a coupling element 178 which is arranged in a sleeve 176 and establishes or releases a torque-transferring connection in dependence on the direction of rotation 180 of the transmission shaft 130 relative to the tool holder 134.

Consequently, concurrent rotation of the tool holder 134 in one direction of rotation 180 can be effected by means of the freewheel coupling 174 whilst simultaneously preventing a rotational movement counter to this direction of rotation 180, due to torsional vibrations or the like for example, from being conveyed back to the transmission shaft 130.

Consequently, in particular the unwanted transmission of torsional vibrations to the holding device 102 can be reduced or completely prevented by means of the freewheel coupling 174.

The connecting device 172 in accordance with the fifth embodiment of the abrading machine 100 is suitable for use in each of the embodiments of an abrading machine 100 that have been described.

The fifth embodiment of the abrading machine 100 that is illustrated in FIG. 13 thus corresponds in regard to the rest of its construction and the other functions thereof with the second embodiment illustrated in FIGS. 2 to 5 for example, and insofar, reference is made to the previous description.

Figure 14:
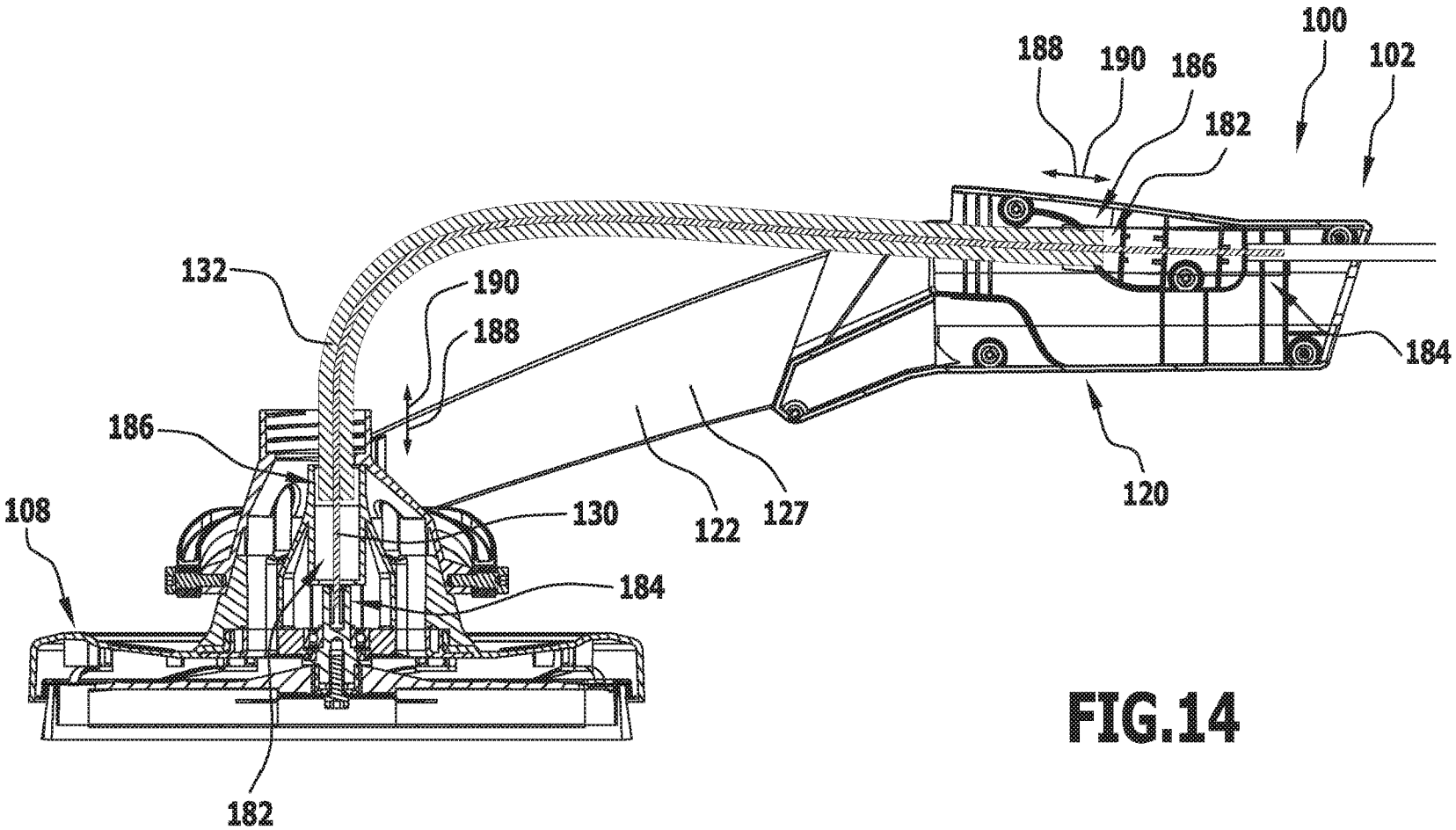
FIG. 14 a schematic vertical longitudinal section through a sixth embodiment of an abrading machine, in which a transmission shaft of the abrading machine and/or a casing of the transmission shaft are moveable relative to shaft holders of the abrading machine.
Figure 15:
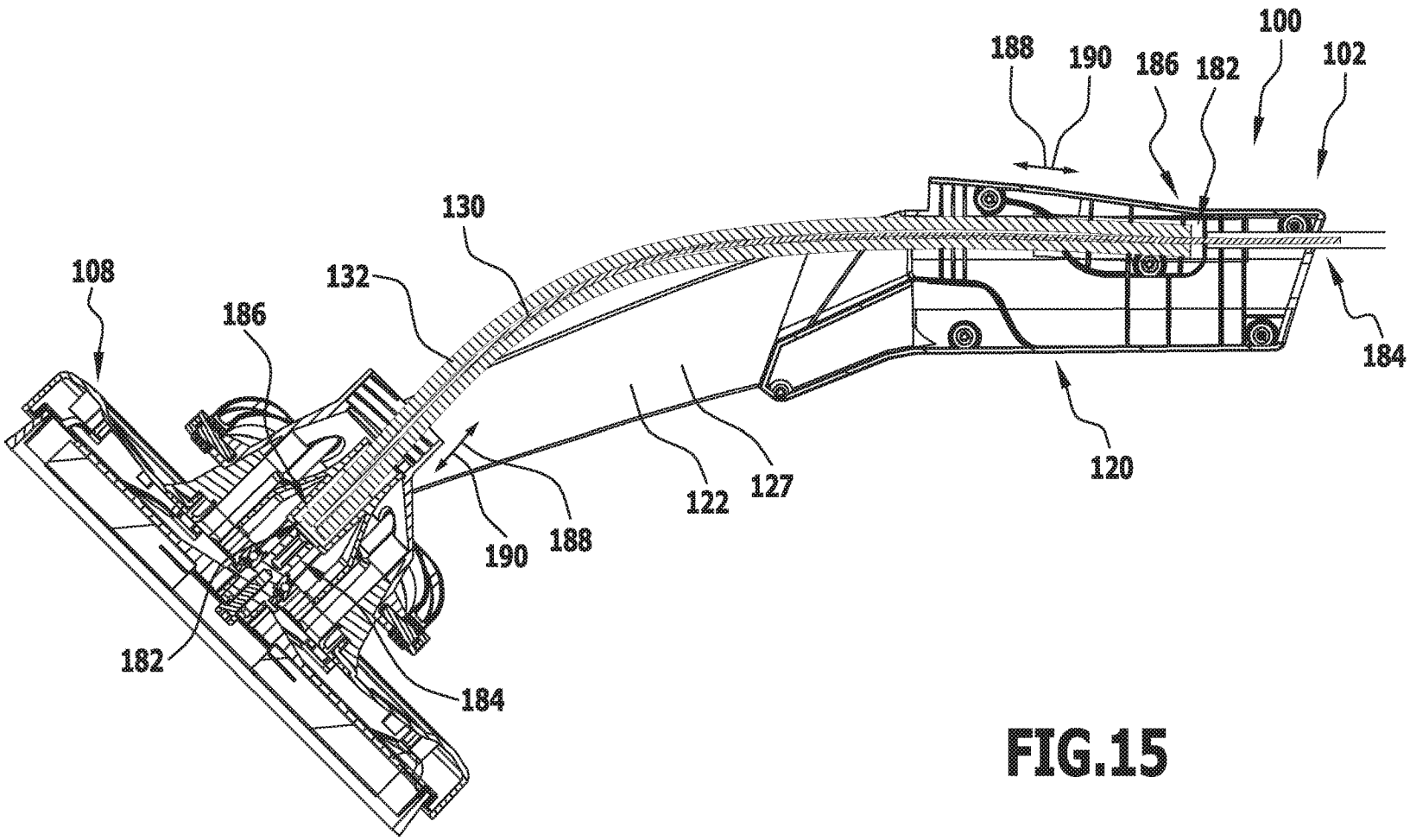
FIG. 15 a schematic illustration corresponding to FIG. 14 of the abrading machine depicted in FIG. 14, wherein the tool head is arranged in an alternative pivotal position.
Figure 16:
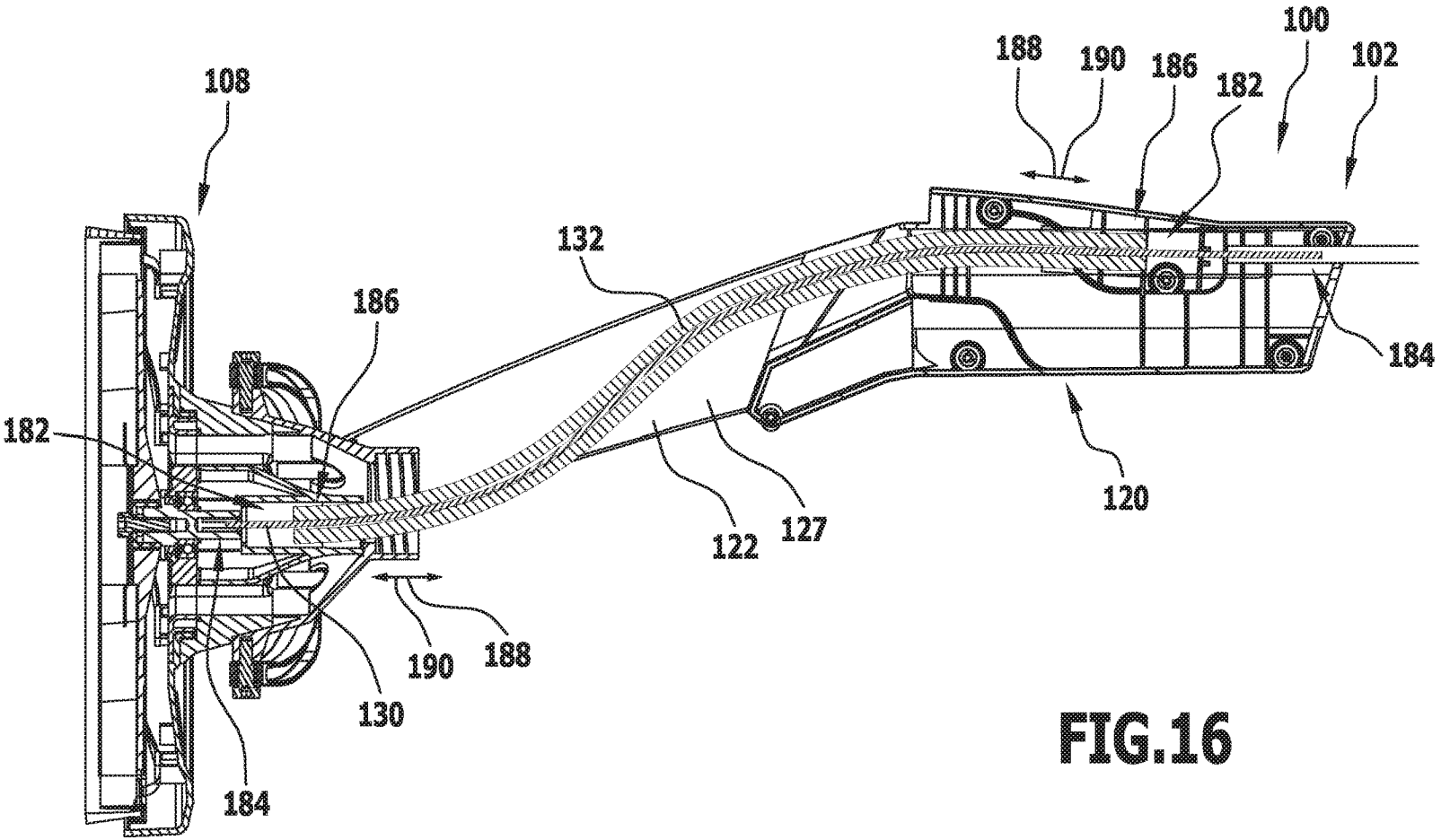
FIG. 16 a schematic illustration corresponding to FIG. 14 of the abrading machine depicted in FIG. 14, wherein the tool head is arranged in a further alternative pivotal position.

A sixth embodiment of a handheld abrading machine 100 which is illustrated in FIGS. 14 to 16 differs from the first embodiment illustrated in FIG. 1 mainly in that the transmission shaft 130 and/or the casing 132 are moveable relative to the holding device 102 and/or relative to the tool head 108 and, in particular, are displaceable.

In particular, in the sixth embodiment of the abrading machine 100 which is illustrated in FIGS. 14 to 16, there are provided two shaft holders 182 for accommodating the ends 184 of the transmission shaft 130 and/or for accommodating the ends 186 of the casing 132.

The ends 184 of the transmission shaft 130 and/or the ends 186 of the casing 132 are thereby preferably displaceable relative to the respectively associated holder 182.

As follows in particular from a comparison of FIGS. 14 to 16 with one another, in particular the ends 186 of the casing 132 as well as an end 184 of the transmission shaft 130 facing the holding device 102 are insertable along a respective push-in direction 188 into the respectively associated shaft holders 182 and are withdrawable therefrom.

In particular, the push-in direction 188 is a main direction of extent 190 of the transmission shaft 130 in the region of the respective shaft holder 182.

As likewise follows furthermore from a comparison of FIGS. 14 to 16 with one another, the casing 132 is displaceable relative to the transmission shaft 130.

The previously described movability of the transmission shaft 130 and the casing 132 that is illustrated in FIGS. 14 to 16 allows a length compensation of the transmission shaft 130 and the casing 132 during pivoting of the tool head 108 relative to the holding device 102.

In particular hereby, unwanted severe bending of the transmission shaft 130 and/or the casing 132 in the different pivotal positions of the tool head 108 can be prevented.

This in the end reduces unwanted counteracting forces during pivoting movements of the tool head 108 so that the abrading machine 100 is less heavily loaded in operation and is more comfortable for a user to handle.

In all other respects, the sixth embodiment of the abrading machine 100 that is illustrated in FIGS. 14 to 16 corresponds in regard to the construction and functioning thereof to the first embodiment illustrated in FIG. 1, and insofar, reference is made to the previous description.

In further (not illustrated) embodiments of handheld abrading machines 100 particular ones or a plurality of the features of the embodiments of abrading machines 100 that have been previously described can be combined with one another in any desired manner.

For example, the moveable accommodation of the transmission shaft 130 and/or the casing 132 in accordance with the sixth embodiment of the abrading machine 100 illustrated in FIGS. 14 to 16 can be used for the further development of the second embodiment of the abrading machine 100 illustrated in FIGS. 2 to 5.

LIST OF REFERENCE SYMBOLS

100 handheld abrading machine
102 holding device
104 drive motor
106 tool
108 tool head
110 handle
112 tubular bar
114 tubing element
116 proximal end
118 moving device
120 distal end
122 fork element
124 swivel ring
126 pivotal axis
127 fork arm
128 pivoting device
130 transmission shaft
132 casing
134 tool holder
136 rotating device
138 displacing device
140 bearing point
142 peg
144 guide channel
146 guidance device
148 toothed wheel device
150 toothed rack device
152 toothed wheel element
154 projection
156 toothed rack element
158 coupling element
160 coupling device
162 articulated joint device
164 multi-articulated linkage device
166 joint
168 component
170 rotational axis
171 lever device
172 connecting device
174 freewheel coupling
176 sleeve
178 coupling element
180 direction of rotation
182 shaft holder
184 end of the transmission shaft
186 end of the casing
188 push-in direction
190 main direction of extent
A distance

What is claimed is:

1. A handheld abrading machine comprising a holding device for holding the abrading machine, a drive motor and a tool head, wherein the tool head is arranged on the holding device such as to be movable by means of a moving device, wherein the tool head is pivotal relative to the holding device about one or more pivotal axes by means of the moving device and wherein a distance (A) of the tool head from the holding device is variable by means of the moving device.

2. An abrading machine in accordance with claim 1, wherein the distance (A) of the tool head from the holding device is variable by means of the moving device by pivoting the tool head about one or more pivotal axes.

3. An abrading machine in accordance with claim 1, wherein a distance (A) of a bearing point of the tool head that is arranged on a fork element from a distal end of the holding device is variable by means of the moving device.

4. An abrading machine in accordance with claim 1, wherein the moving device comprises a rotating device for pivoting the tool head about one or more pivotal axes and a displacing device for displacing the tool head relative to the holding device.

5. An abrading machine in accordance with claim 1, wherein the moving device comprises a displacing device for displacing the tool head relative to the holding device, wherein the displacing device is integrated into a fork element of the abrading machine.

6. An abrading machine in accordance with claim 1, wherein the moving device comprises a coupling device in the form of a toothed wheel device and/or a toothed rack device for positively coupling the pivotal movement of the tool head to the movement of the tool head for the purposes of changing the distance (A) from the holding device.

7. An abrading machine in accordance with claim 1, wherein the moving device comprises a guidance device and in particular a guide channel along which the tool head is displaceable for the purposes of changing the distance (A) from the holding device.

8. An abrading machine in accordance with claim 1, wherein the moving device comprises a multi-articulated linkage device which has two or more rotational axes running in parallel with each other.

9. An abrading machine in accordance with claim 8, wherein the multi-articulated linkage device is a positively-coupled multi-articulated linkage device in which a change in an angular position of one joint of the multi-articulated linkage device effects a change in an angular position of another joint of the multi-articulated linkage device, and in particular, of all the other joints of the multi-articulated linkage device.

10. An abrading machine in accordance with claim 1, wherein the moving device comprises a lever device by means of which the tool head is pivotal into predefined pivotal orientations.

11. An abrading machine in accordance with claim 1, wherein a tool holder of the tool head is coupled to the drive motor by means of a transmission shaft, wherein the abrading machine comprises at least one connecting device for connecting the transmission shaft to the drive motor and/or to the tool holder of the tool head in torque-transmitting manner, wherein the connecting device comprises a free-wheel coupling for transmitting torque in only one direction of rotation.

12. An abrading machine in accordance with claim 1, wherein a tool holder of the tool head is coupled to the drive motor by means of a transmission shaft, wherein the abrading machine comprises two shaft holders for holding two ends of the transmission shaft and/or two ends of a casing of the transmission shaft, wherein at least one end of the transmission shaft and/or at least one end of the casing is moveable relative to the associated shaft holder.

13. An abrading machine in accordance with claim 12, wherein at least one end of the transmission shaft and/or at least one end of the casing is moveable relative to the associated shaft holder along a main direction of extent of the transmission shaft in a region of the associated shaft holder.

14. An abrading machine in accordance with claim 12, wherein the casing and the transmission shaft are displaceable relative to each other.

15. An abrading machine in accordance with claim 12, wherein a shaft holder is arranged on the tool head and/or a shaft holder is arranged at a distal end of a substantially tubular bar of the holding device.

* * * * *